United States Patent [19]

Graham

[11] Patent Number: 4,832,328

[45] Date of Patent: May 23, 1989

[54] REPLACEABLE CARTRIDGE SYSTEM FOR CONVEYOR APPARATUS

[75] Inventor: John F. Graham, Colinton, Scotland

[73] Assignee: Unisys Corporation, Blue Bell, Pa.

[21] Appl. No.: 94,476

[22] Filed: Sep. 8, 1987

[30] Foreign Application Priority Data

Sep. 9, 1986 [GB] United Kingdom ..... 8621695

[51] Int. Cl.[4] ..... B65H 3/04

[52] U.S. Cl. ..... 271/35; 271/145; 271/162; 221/259

[58] Field of Search ..... 271/34, 35, 145, 162; 221/197, 199, 259; 198/570, 817

[56] References Cited

U.S. PATENT DOCUMENTS

| | | | |
|---|---|---|---|
| 3,870,140 | 3/1975 | Wieser | 198/817 |
| 3,923,148 | 12/1975 | Dorner | 198/570 |
| 4,511,028 | 4/1985 | Meister | 198/817 X |

*Primary Examiner*—Joseph J. Rolla

*Assistant Examiner*—Edward S. Ammeen

*Attorney, Agent, or Firm*—Mark T. Starr

[57] ABSTRACT

A system in which an easily replaceable cartridge containing conveyor mechanisms such as wheels and belts, and a base for mounting the cartridge transports documents. The cartridge includes a carcass having a plurality of recesses in which respective wheels are disposed. When the cartridge is not mounted on the base, the wheels are retained within the recesses in contact with the carcass by belts which encircle the carcass. The base includes a plurality of bearing members of like member to the wheels. When the cartridge is mounted on the base, the wheels are engaged by the bearing members. The base is provided with a tensioning device which, when operated, tensions the belt and spaces the wheels away from the carcass, permitting them to rotate freely about their associated bearing members. At least one of the wheels is retained upon a hub assembly by a click-on, click-off mechanism requiring only single handed operation.

12 Claims, 7 Drawing Sheets

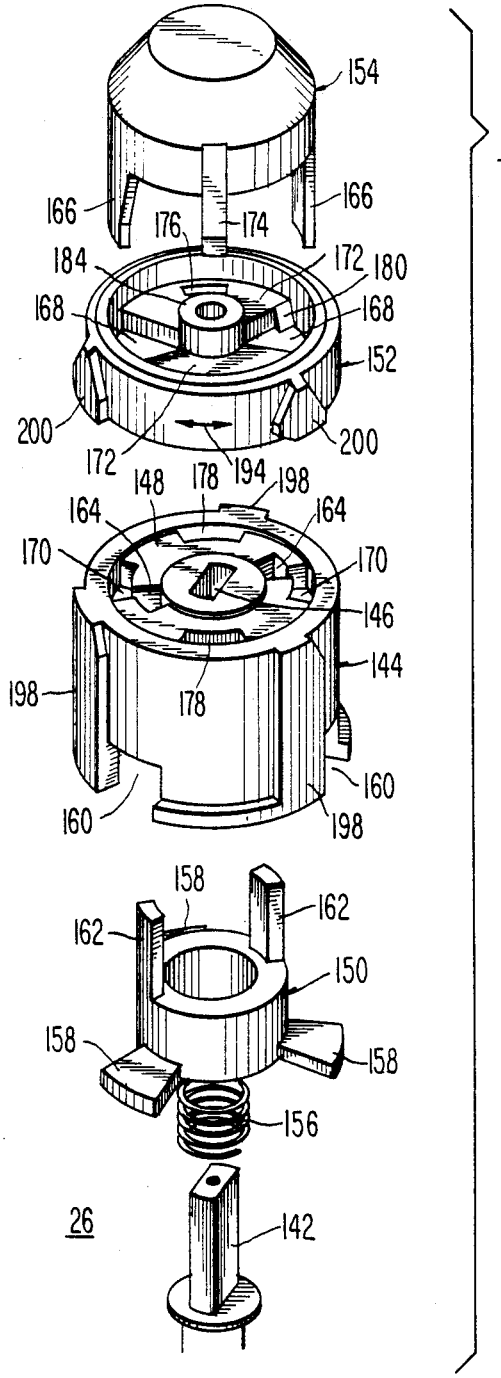
Fig.10
Fig.11
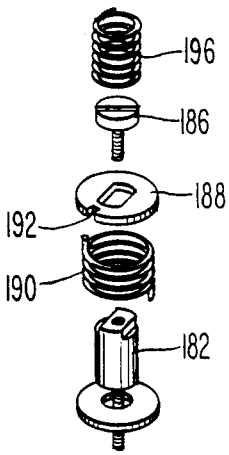

REPLACEABLE CARTRIDGE SYSTEM FOR CONVEYOR APPARATUS

BACKGROUND OF THE INVENTION

The present invention relates to a system including a replaceable cartridge comprising replaceable wheel members.

The present invention is hereinafter disclosed with reference to a document encoding machine where documents are taken from a stack and fed into a track. The invention is not restricted to such an application. The invention may be used in any circumstances where two or more wheels and/or a belt can be removed and replaced.

Document encoding equipment operates upon bankers checks and other like documents to gain printed or magnetic data from the documents and to apply coded marks to the documents for their later machine processing. Before any action can be taken upon the documents, the documents must first be fed into a document track, along which lie various sensors, document readers and document printers. The documents are fed into the track from a stack. An elastically faced drive wheel and drive belts urge documents from the stack between the drive wheel and a scrub wheel one-by-one into the track. The scrub wheel and driven wheel rotate at different speeds and consequently the surfaces abrade against one another. The slow mutual attrition between the drive wheel and the scrub wheel means that both of these items require periodic replacement. Likewise the belts associated with the drive wheel also require replacement as they stretch and become unserviceable.

The act of replacing the drive wheel and/or the drive belts can be time consuming. Before the drive wheel can be removed, tension in the drive belts must be released, the drive belts removed from the drive wheel and the drive wheel released from its mounting shaft. Since one drive belt is provided at the base of the drive wheel and another at the top of the drive wheel, in order to remove and change the drive belts, it is necessary to maneuver the bottom drive belt all the way up the drive wheel assembly before it can be removed. The changing of the belts or drive wheel requires skilled service personnel using tools and both hands. The present invention seks to provide improvement through use of a replaceable cartridge system allowing rapid one-handed changeover by personnel who are not required to be skilled and without the use of the tools.

SUMMARY OF THE INVENTION

The present invention consists in a system including a replaceable cartridge and a base for receiving the cartridge; said cartridge including a plurality of replaceable wheel members; said base including a plurality of bearing members, one for each of said plurality of wheel members, each permitting the rotation of its respective wheel member there-about; said cartridge including a central carcass, having a plurality of recesses, there being one recess for each of said plurality of wheel members: and an elastic belt passing around the outside of said carcass; said belt being operative to retain each of said plurality of wheel members in its respective recess when said cartridge is not on said base; where, when said cartridge is engaged with said base, said carcass is located on said base such that each of said plurality of bearing members co-operates with its respective wheel member to space said wheel members away from said carcass.

In a preferred embodiment of the invention, the cartridge comprises a drive wheel, a first idler wheel, a second idler wheel and first and second drive belts passing around the carcass, around the drive wheel and being supported by the first and second idler wheels. The belts co-operate with the idler wheels and the drive wheel when the cartridge is not mounted on a base to retain the idler wheels and the drive wheel in recesses on the cartridge.

In the preferred embodiment there is provided a base having first and second idler pins and a feed hub assembly. When the drive wheel is located upon the feed hub assembly the first and second idler wheels respectively self-locate upon the first and second idler pins. The carcass locates upon first and second carcass locating pins on the base.

Also in the preferred embodiment the feed hub assembly and the drive wheel co-operate to provide a self-gripping, push button ejection holding means for retaining the drive wheel on the feed hub assembly. The preferred embodiment also provides that the first and second idler pins and at least one of the carcass locating pins is mounted upon a movable plate over a baseplate whereon the feed hub assembly is fixed. A tensioning lever located on the baseplate is moved from an open to a closed position for activating a cam mechanism to move the movable plate so that the belts are tensioned with the drive wheel and idler wheels free from the recesses in the carcass.

BRIEF DESCRIPTION OF THE DRAWING

The invention is further explained, by way of an example, by the following description in conjunction with the appended drawings, in which:

FIG. 10 shows an exploded view of the components making up the feed hub assembly otherwise shown in FIG. 2.

FIG. 11 shows spring and locating elements provided between the release button and locking ring of FIG. 10.

DESCRIPTION OF THE PREFERRED EMBODIMENT

Figure 1:
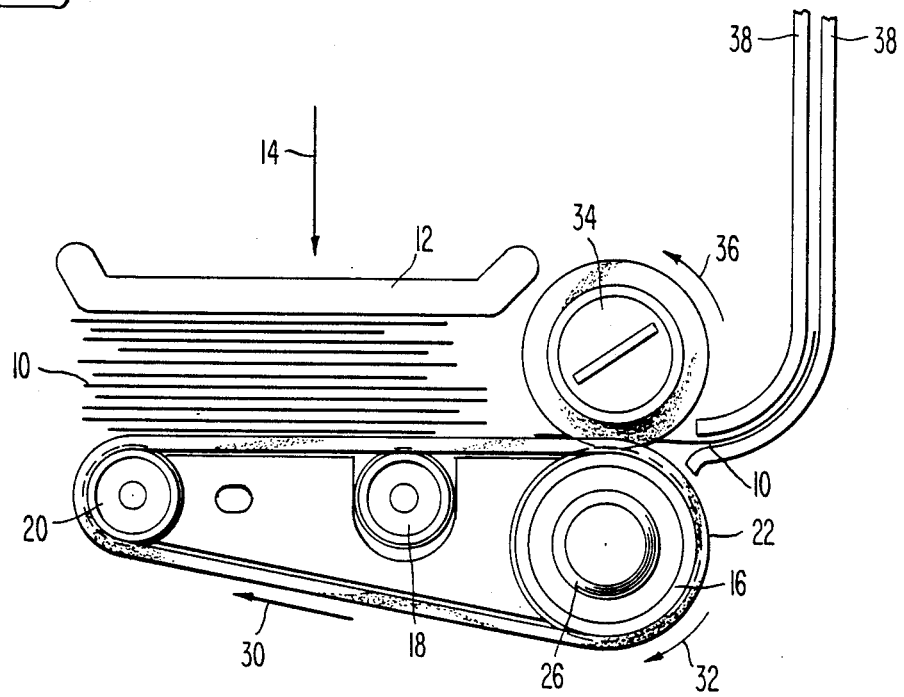
FIG. 1 shows the environment wherein the replaceable cartridge of the preferred embodiment is used.

FIG. 1 shows the environment wherein the cartridge of the present preferred embodiment is used.

Figure 4:
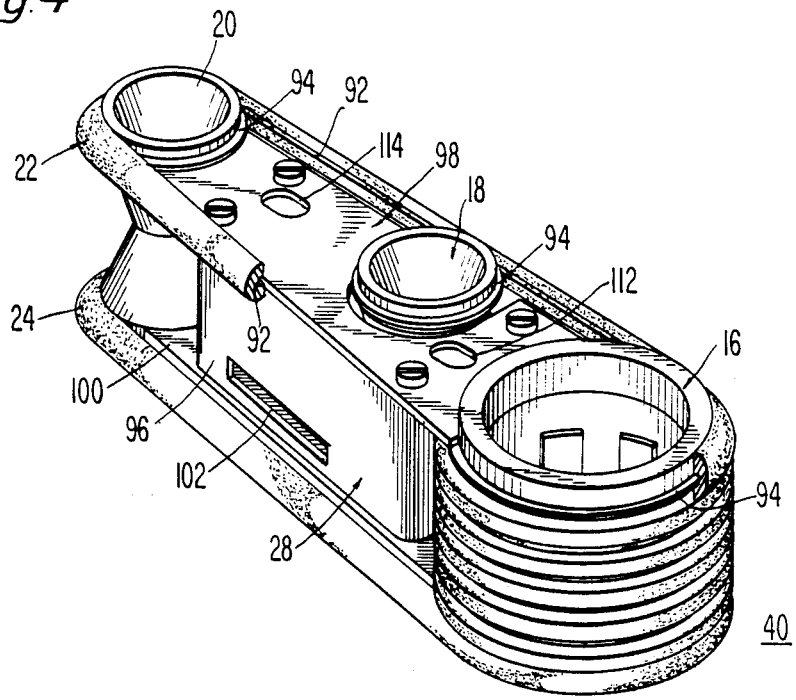
FIG. 4 shows a projected view of the replaceable cartridge.

Documents 10 are urged by a spring loaded plate 12 as indicated by the first arrow 14 towards the drive assembly comprising a drive wheel 16, a first idler wheel 18, a second idler wheel 20, a first belt 22, shown in FIG. 1 and a second belt 24, not visible in FIG. 1 but otherwise shown in FIG. 4. A feed hub assembly 26 rotates the drive wheel 16. The first and second belts 22,24 pass around the drive wheel 16 and are supported by the first 18 and second 20 idler wheels. The first and second belts 22,24 are held clear of a cartridge carcass 28. The first and second belts 22,24 move as indicated by a second arrow 30 and the drive wheel rotates as indicated by a third arrow 32. The first and second belts 22,24 move the documents 10 towards the drive wheel 16 which is opposed by a scrub wheel 34. The scrub wheel 34 rotates as indicated by a fourth arrow 36. Both the scrub wheel 34 and the drive wheel 16 are elastically faced. The first and second belts 22,24 drive documents 10 towards the pinch between the scrub wheel 34 and the drive wheel 16. The scrub wheel 34 rotates at a slightly different speed from the drive wheel 16 such that, if two documents 10 are presented together to the pinch between the drive wheel 16 and the scrub wheel 34 the documents 10 are separated such that only one document 10 is urged into a document track defined by track walls 38.

The elastic coated faces of the drive wheel 16 and of the scrub wheel 34 rub against one another with a differential speed when no docment or a single document is presented therebetween. The drive wheel 16 and the scrub wheel 34 thus have their surfaces slowly worn away and otherwise degraded during use. It becomes necessary periodically to change the drive wheel 16. At other times the scrub wheel 34 may require changing and at still other times the first and second belts 22,24 may require to be changed due to loss of surface friction, stretching and other ageing effects having impaired their document 10 transporting capability.

As best seen in FIG. 4, the replaceable cartridge comprises the carcass 28, the first and second belts 22,24, and the first and second idler wheels 18,20. The replaceable cartridge is generally designated by the reference numeral 40.

Figure 2:
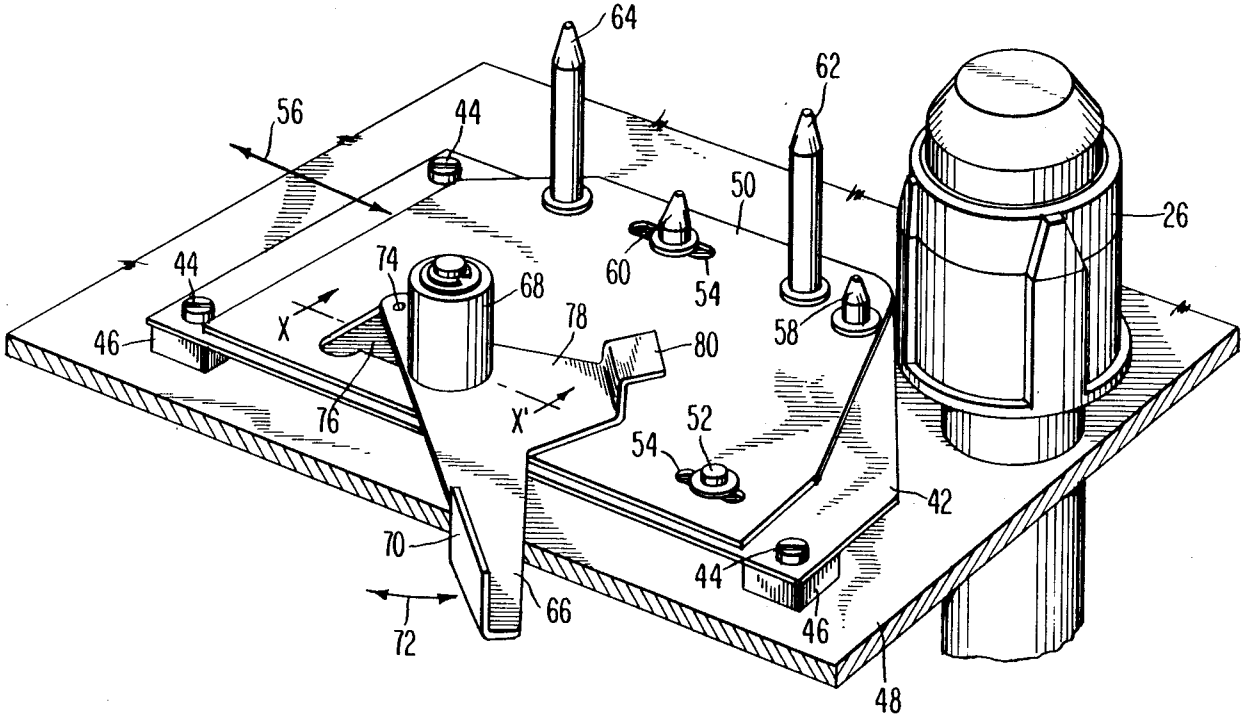
FIG. 2 shows the base assembly used in association with the replaceable cartridge of FIG. 1.

FIG. 2 shows the base whereon the replaceable cartridge 40 is mounted. A baseplate 42 is held by screws 44 onto raised bosses 46 on a base casting 48 in a document encoding machine. An upper plate 50 is held onto the baseplate 42 by one or more sliding retainers 52 engaging the baseplate 42 and passing through slots 54 in the upper plate 50 to allow a degree of movement of the upper plate 50 relative to the baseplate 42 as indicated by the fifth, bi-directional arrow 56. A first carcass locating pin 58 is fixed to the upper plate 50. A second carcass locating pin 60 is fixed to the baseplate 42 and passes through a slot 54 in the upper plate 50 to act in part as a sliding retainer for the upper plate 50 on the baseplate 42.

A first idler pin 62 intended to engage and locate first idler wheel 18 is affixed to the upper plate 50. Similarly a second idler pin 64 is affixed to the upper plate 50 and is intended to engage and locate the second idler wheel 20.

A tension lever 66 is mounted on a tension lever pivot 68 to be rotatable above a fixed point on the baseplate 42 and to allow the upper plate 50 to slide as indicated by the fifth arrow 56. The tension lever pivot 68 has a large diameter properly to retain the tension lever 66 flat against the upper plate 50 as the upper plate 50 moves. It is to be understood that a slot [concealed in FIG. 2] is provided in the upper plate 50 beneath the tension lever 66 to allow that movement.

A handle member 70 is provided to allow movement as indicated by the sixth bi-directional arrow 72 of the tension lever 66 from an open to a closed position and vice versa. FIG. 2 shows the tension lever 66 in the fully open position whereat removal of the cartridge assembly 40 is allowed.

The tension lever 66 comprises a cam arm 74 which moves in a cam recess 76 in the upper plate 50. The tension lever 66 further comprises a locking arm 78 having a raised lip portion 80 operative to engage the carcass 28 of the replaceable cartridge 40 when the tension lever 66 is in the closed position in a manner hereinafter described.

Figure 3:
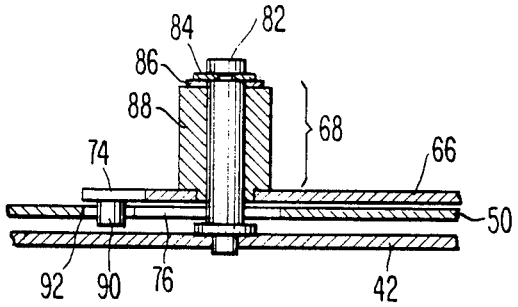
FIG. 3 shows a cross-sectional view along the line X X′ of the tensioning arm assembly of FIG. 2.

FIG. 3 shows a cross sectional view of the tension lever 66, the upper plate 50, the baseplate 42 and the tension lever pivot 68 all shown in FIG. 2.

The tension lever pivot 68 comprises a central pin 82 fixed into the baseplate 42. The cam recess 76 extends to and surrounds the central pin 82. An elastic clip 84 on a spacing adjusting washer 86 holds a retaining collar 88 against the upper surface of the tension lever 66. A cam roller 90 is affixed near the end of the cam arm 74 and is operative to engage the leading edge 92 of the upper plate 50 where it forms the boundary of the cam recess 76.

FIG. 4 shows a projected view of the replaceable cartridge 40 otherwise shown in FIG. 1. The upper belt 22 is shown in partially sectioned form to reveal a groove 92 provided in the first belt 22 which engages a belt retaining rim 94 provided in the drive wheel 16, and in the first 18 and second 20 idler wheels. It is to be understood that the second belt 24 comprises a similar groove 92 which engages similar belt retaining rims 94.

A central carcass 28 comprises a body portion 96 together with an upper carcass plate 98 and a lower carcass plate 100. A locking recess 102 is provided in the body portion 96 of the carcass 28 and is engaged by the raised lip portion 80 of the locking arm 78 on the tension lever 66 when the tension lever 66 is in the fully closed position to retain the replaceable cartridge 40 on the upper plate 50.

Figure 5:
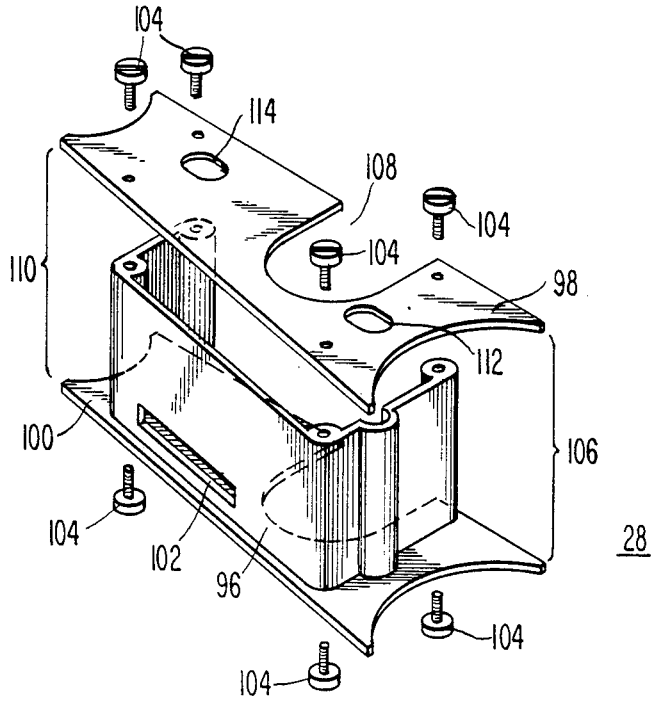
FIG. 5 shows an exploded view of the carcass of the cartridge otherwise shown in FIG. 4.

FIG. 5 shows an exploded view of the carcass 28.

Screws 104 pass through the upper cartridge plate 98 and the lower carcass plate 100 to provide attachment to the body portion 96. The upper 98 and lower 100 carcass plates are of similar outline and vertically aligned one with the other. First ends of the upper and lower carcass plates 98,100 are given an arcuate form to provide a drive wheel recess 106 where the drive wheel 16 is retained with the upper carcass plate 98 above the belt retaining rim 94 and the lower carcass plate 100 below the belt retaining rim 94 which engages the second belt 24. When the drive wheel 16 is urged into the drive wheel recess 106 it is thus retained in a predetermined vertical position by virtue of the upper and lower carcass plates 98,100 engaging the belt retaining rims 94.

A first idler wheel recess 108 is formed in both the upper and lower carcass plates 98,100. In FIG. 5 the first idler wheel recess 108 is not visible in the lower carcass plate 100. It is however to be understood that a similar recess exists in the lower carcass plate 100 as that shown as 108 in the upper carcass plate 98.

The first idler wheel recess 108 is of greater diameter than the spindle or body portion of the first idler wheel 18 but of a lesser diameter than the belt retaining rim 94 provided on the first idler wheel 18. When the first idler wheel 18 is in the first idler wheel recess 108 it is retained by the upper and lower carcass plates 98,100 trapping the belt retaining rim 94 for the first belt 22 and the belt retaining rim 94 for the second belt 24 therebetween.

At a second end of the upper carcass plate 98 and the lower carcass plate 100 there is provided a mutually vertical pair of arcuate cut-away portions co-operating as a second idler wheel recess 110. When the second idler wheel 20 is in the second idler wheel recess 110 it is vertically restrained by virtue of the upper carcass plate 98 and the lower carcass plate 100 trapping between them the belt retaining rim 94 for the first belt 22 and the belt retaiing rim 94 for the second belt 24.

The first belt 22 and the second belt 24 are both elastic. They co-operate to urge the drive wheel 16 into the drive wheels recess 106, to urge the first idler wheel 18 into the first idler wheel recess 108, and to urge the second idler wheel 20 into the second idler wheel recess 100. The urging and retaining action of the first and second belts 22,24 together with the vertical restraint impaired by the upper and lower carcass plates 98,100 engaging the belt retaining rims 94, ensures that when the replaceable cartridge 40 is not in position on the upper plate 50 the belts 22,24, the idler wheels 18,20 and the drive wheels 16 all reamin in their proper positions with respect to the carcass 28.

Shown in FIG. 5 on the upper carcass plate 98 is a first elongated carcass retaining slot 112 and a second elongated carcass retaining slot 114. The first and second carcass retaining slots 112,114 are required to be present only in the lower carcass plate 100. For convenience of illustration due to their concealment in FIGS. 4 and 5 in the lower carcass plate 100, and for the convenience of having the upper and lower carcass plate 98,100 identical to one another, the first and second elongated carcass retaining slots 112,114 are shown as also being present in the upper carcass plate 98. When the replaceable cartridge 40 is placed upon the upper plate 50 the first elongated carcass retaining slot 112 in the lower carcass plate 100 engages the first carcass locating pin 58 and the second elongate carcass retaining slot 114 engages the second carcass locating pin 60. The elongated nature of the first and second elongated carcass retaining slots 112,114 permits a degree of freedom of movement of the carass 28.

Figure 6:
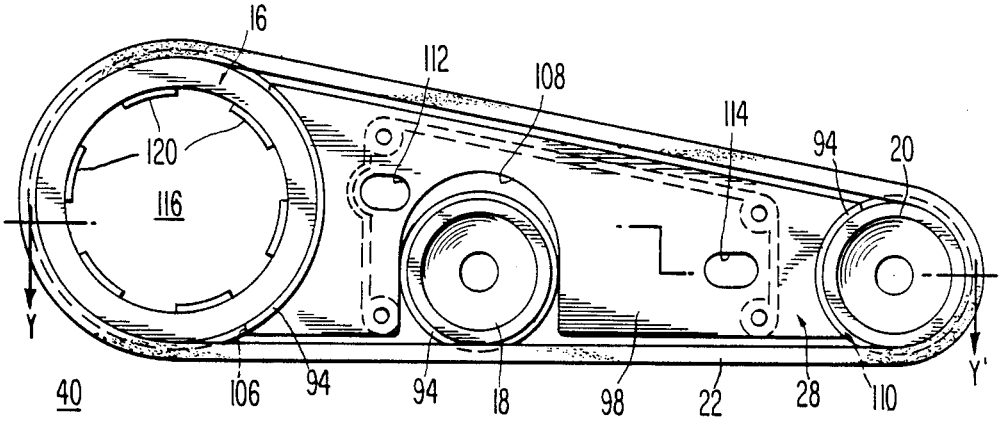
FIG. 6 shows a plan view of the cartridge.
Figure 7:
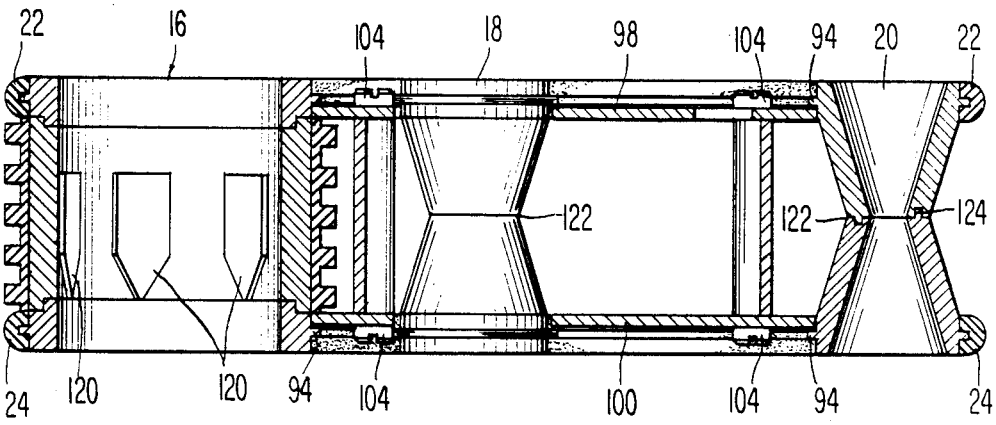
FIG. 7 shows a sectional view through the cartridge taken along the line Y Y′ of FIG. 6 and looking in the direction of the arrows.

FIG. 6 shows a plan view of the replaceable cartridge 40 of FIG. 4 and FIG. 7 shows a cross sectional view taken along the line Y Y' of FIG. 6 looking in the direction of the arrows. In FIG. 6 the carcass 28 is shown in phantom outline beneath the upper carcass plate 98. New features shown in FIGS. 6 and 7 include details of the drive wheel 16. The drive wheel 16 comprises a central portion 116 affixed above and below to a pair or edge portions which carry the belt retaining rim 94. Locating splines 120 are provided on the inner surface of the central portion 116. The locating splines 120 co-operate with the feed hub assembly 26 in a manner herinafter described.

FIG. 7 shows further detail of the first and second idler wheels 18,20. For convenience the first idler wheel 18 is shown not in cross sectional view. Both the first 18 and second 20 idler wheels have a waisted section 122 which keeps them back from the plane defined by the first 22 and second 24 belts so as not to interfere with the transportation of documents 10. The first 18 and second 20 idler wheels are generally formed by the joining of two identical frusto-conical sections to form the waist. In FIG. 7 it is further illustrated how these two frust-conical sections may be joined by a series of pins 124. The frusto-conical sections may thus be made identical to one another and later assembled to form the first 18 and second 20 idler wheels.

Figure 8:
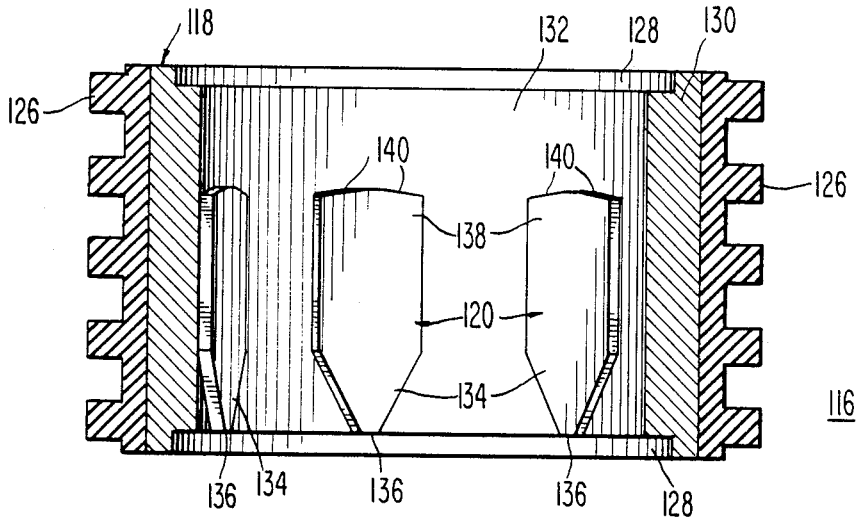
FIG. 8 shows an enlarged cross-sectional view of the drive wheel.
Figure 9:
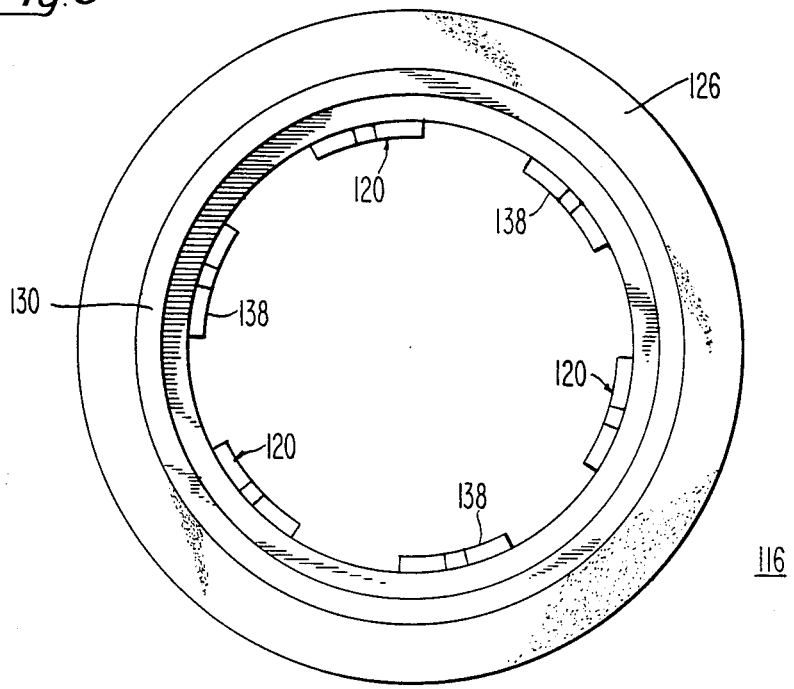
FIG. 9 shows an enlarged plan view of the drive wheel.

FIGS. 8 and 9 show respectively an enlarged cross section and plan views of the central portion 116 of the drive wheel 16. An outer layer 126 of polyurethane foam is provided for gripping documents 10. Lip 128 is provided for attachment of the edge portions 118. The attachment may be by friction, by glueing or by any desired means. Alternatively the edge portions 118 can be moulded integrally with the central portion 116. The manner of construction here illustrated for preference allows simple and convenient addition of the outer layer 126.

The outer layer 126 is attached to a core 130 and the locating splines 120 are provided on the inner surface 132 of the core 130.

Each locating spline 120 comprises a tapered leading end 134 terminating in a flat leading surface 136 at its lower end.

Each locating spine comprises a top edge 138 having sloping surfaces 140 sloping away from the center of the top edge 138 in either direction at a shallow angle so that the top edge 138 presents a similar outline to the tapered leading end 134 but with a less acute angle.

FIG. 10 shows an exploded view of the feed hub assembly 26 of the FIGS. 1 and 2. A shaft 142 passes into the feed hub assembly 26 and has one or more flat surfaces to cause the feed hub assembly 26 to rotate with the shaft 142. A hub base 144 comprises a keyed aperture 146 set in an upper platform 148. The upper platform 148 comprises three types of apertures whose purpose is later described.

An ejector ring 150 is situated within the hub base 144. A locking ring 152 is provided immediately above the hub base 144 and a release button 154 fits into the locking ring 152.

The ejector ring 150 is urged upwards on the shaft 142 by an ejector ring spring 156. The ejector ring 150 comprises three ejector ring flanges 158 which, when the feed hub assembly is complete, protrude radially through corresponding ejector ring flange openings 160 in the hub base 144. The ejector ring 150 further comprises a pair of locking arms 162 which, when the feed hub assembly 26 is complete, are contained in locking arm passages 164 in the upper platform 148 of the hub base 144.

The release button 154 comprises a pair of release arms 166 which pass through voids 168 in the locking ring 152 to be accommodated in release arm passages 170 in the upper platform 148 of the hub base 144. The voids 168 are provided in a central platform 172 in the locking ring 152.

The release button 154 further comprises securing legs 174 only one of which is visible in FIG. 10. The securing legs 174 pass through circumferentially extensive arcuate securing leg voids 176 in the central platform 172 of the locking ring 152. Once again only one securing leg void 176 is visible in FIG. 10. It is however to be appreciated that the button 154 and the locking ring 152 enjoys a diametric symmetry.

The securing legs 174 pass into securing leg passages 178 in the upper platform 14 of the hub base 144 where lips at the distal ends of the securing legs 174 prevent ejection of the release button 154 beyond a predetermined distance.

A pair of wedges 180 [only one of which is visible in FIG. 10] is provided at the edge of each void 168 positioned to co-operate with the release arms 166 in a manner later to be described.

FIG. 11 shows a spring and post assembly provided between the release button 154 and the locking ring 152 of FIG. 10. A pilot post 182 screws into the top of the shaft 142. The pilot post 182 passes through a central pillar 184 of the locking ring 152. A retaining screw 186 holds a locking spring retention plate 188 in a key-retained position on top of the pilot post 182 and on top of the central pillar 184 of the locking ring 152. A locking spring 190 engages a notch 192 in the locking spring retention plate 188 with a first end and engages the central platform 172 of the locking ring 152 with a second end. The locking spring retention plate 188 and the locking spring 190 co-operate to urge the locking ring 152 to rotate relative to the hub base 144 as indicated by a seventh arrow 194.

A release button pressure spring 196 is provided between the locking spring retention plate 188 and the underside of the release button 154 to space the release button 154 away from the locking ring 152 and to restore the position of the release button 154 after it has been depressed and released.

The hub base 144 comprises three drive splines 198 on its outer surface. The locking ring 152 comprises three matching locking caps 200 generally triangular in form with the apex of the triangle pointing upwards and so positioned around the locking ring 152 as to provide tops or upper portions to the drive splines 198 when the feed hub assembly 26 is in the feed wheel 16 releasing position hereinafter described.

Figure 12:
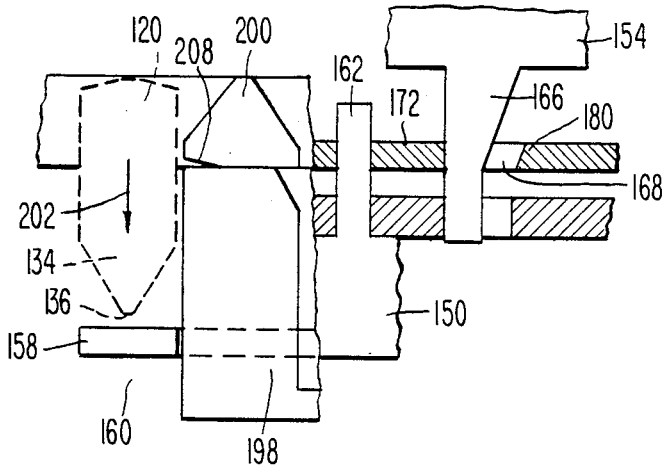
FIG. 12 shows a first stage of insertion of the drive wheel onto the feed hub assembly.
Figure 13:
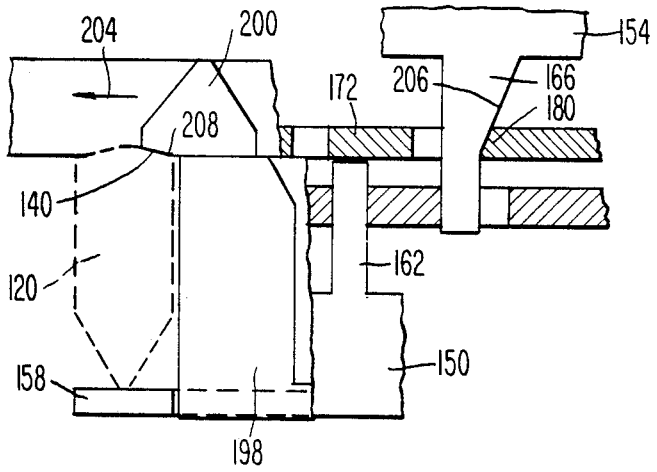
FIG. 13 shows the second and final locking stage of the insertion of the drive wheel onto the feed hub assembly.
Figure 14:
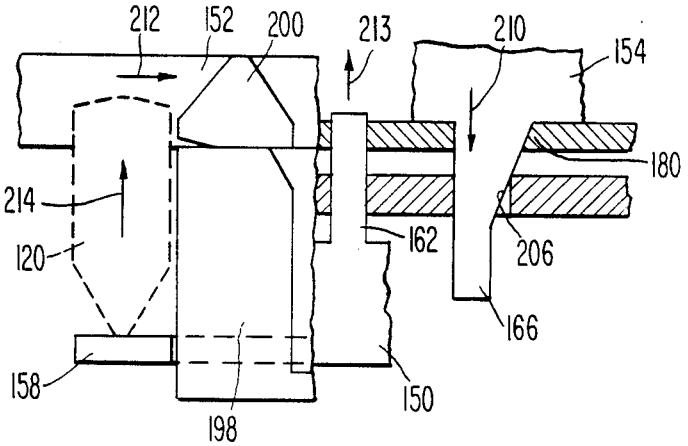
FIG. 14 shows the manner in which the drive wheel assembly is released from the drive hub assembly by depression of the release button.

FIGS. 12,13 and 14 are highly schematic representations of stages in the sequence whereby the drive wheel 16 is a first fixed onto the feed hub assembly 26 and thereafter released by depression of the release button 154. In FIGS. 12, 13 and 14 the locking arms 162 are shown as being closer to the drive splines 198 than the release arms 166. This is a matter purely of schematic convenience so drawn to clarify and simplify the explanation. It is to be understood that the locking arms 162 are at a smaller radius on the hub base 144 than the release arms 166. It is also to be appreciated that the locking arms 162 are represented as passing through their own void in the central platform 172 of the locking ring 152 whereas in three dimensional reality from inspection of the locking arm passages 164 the locking arms 162 in fact engage the edge of the void 168 at a different circumferential position from the release arms 166 and closer to the center than the wedges 180.

With the above metamorphosis in mind, FIG. 12 shows the first stage of insertion of the drive wheel 16 over the feed hub assembly 26. FIG. 12 shows the feed hub assembly 26 in its open position. The locking arms 162 are urged fully upwards by the ejector ring spring 156 so that the locking arms pass up through the central platform 172 and through the locking arm passages 164 to engage the edge of the void 168 and to retain the locking ring 152 against pressure from the locking spring 190 in a position where the locking caps 200 are immediately over the tops of the drive splines 198. The drive wheel 16 is introduced over the top of the feed hub assembly 26 and pushed down. The locating splines 120 are so spaced [being six in number]relative to the drive splines 198 [three in number]that a locating spline 120 is always urged up against the side of a drive spline 198 as indicated in FIG. 12. It is not essential that there be three drive splines 198 and six locating splines 120. The number of drive splines 198 can equal the number of locating splines 120. There can be as few as two and as many as is desired of each kind provided the combination of circumferential extent and circumferential disposition of each type allows for the sequence of operations shown in FIGS. 12, 13 and 14.

As the locating spline 120 is urged as indicated by an eighth arrow 202 so it locates itself circumferentially by virtue of its tapered leading edge 134 interacting with the triangular locking caps 200 and the flat leading surface 136 of the locating spline 120 engages the ejector ring flange 158 and causes the ejector ring 150 to be bodily depressed counteracted by the ejector ring spring 156 which is compressed in the process. Depression of the ejector ring 150 causes corresponding depression of the locking arms 162. FIG. 13 shows the second stage of drive wheel 16 insertion where the locking arm 162 has completely disengaged the edge of the void 168 as the ejector ring 150 is fully depressed. The locking ring 152 is now free to rotate as indicated by the ninth arrow 204. The central platform 172 of the locking ring 152 passes over the top of the locking arms 162 and so retains the ejector ring 150 in a fully depressed condition. Rotation of the locking ring 152 relative to the hub base 144 is stopped at a predetermined limit by the wedge 180 engaging the release arm 166. The release arm 166 comprises a sloping section 206 which co-operates with the wedge 160 when the release button 154 is depressed [later described].

As the locking ring 152 moves so the locking caps 200 move as indicated by the ninth arrow 204 to engage the top edges 138 of the locating splines 120. Each locking cap 200 comprises tilted section 208 on its lower surface which co-operates with a sloping surface 140 of the locating spline 120 to urge the locating spline firmly downwards into the hub base 144 and so retain the drive wheel 16 firmly in place.

FIG. 14 discloses the manner in which the drive wheel 16 is released from the feed hub assembly 26 and the feed hub assembly 26 returned to its locked-open position. As the release button 154 is depressed as indicated by a tenth arrow 210 so the sloping section 206 of the release arm 166 engages the wedge 180 and urges the locking ring 152 in the direction indicated by an eleventh arrow 212 against the tension of the locking spring 190. The locking cap 200 is returned to vertical alignment with the drive spline 198 and the locking arm 162 is released from beneath the central platform 172 of the locking ring 152. The ejector ring 150 is then free to rise as shown by the twelfth arrow 213 and the ejector ring flange 158 pushes upon the locating spline 120 urged by the ejector ring spring 156 to push the locating spline 120 and thus the drive wheel 16 up from the feed hub assembly as indicated by a thirteenth arrow 214. The drive wheel 16 may then freely be removed from the feed hub assembly 26. When the release button 154 is no longer depressed the release button pressure spring 196 restores its position and the situation of FIG. 12 once more prevails.

To summarize, when the drive wheel 16 is inserted over the feed hub assembly and pushed down against spring pressure the locking ring 152 clicks over and holds the drive wheel 16 in place. When thereafter the release button 154 is depressed the drive wheel 16 is released and pops up from the feed hub assembly 26.

It is to be recalled that the drive wheel 16 is in fact part of the cartridge 40. In use the release button 154 is depressed, the tension lever 66 moved to the open position and the old cartridge 40 simply lifted off and discarded. A new cartridge is inserted by locating the drive wheel 16 over the feed hub assembly 26 and pushing down until the drive wheel 16 clicks home in the locked position. Inspection of FIG. 7 shows that the internal profiles of the first and second idler wheels 18,20 are fundamentally conical allowing them to self-locate onto the first and second idler pins 62,64. The first and second elongated carcass retaining slots 112,114 respectively engage the first and second carcass retaining pins 58,60. Once again there is a large degree of positional tolerance due to the elongated nature of the retaining slots 112,114. Having initially located the cartridge 40 on the upper plate 50 the first and second belts 22,24 still urge the wheel wheel 16,18,20 against the carcass 28 with sufficient friction to prevent their rotation. The next stage is for the tension lever 66 to be moved from the open to the closed position. In so moving the cam arm 74 moves the cam roller 98 in the cam recess 76 to urge the upper plate 50 away from the feed hub assembly 26. This has the effect of moving the first idler pin 62 and the second idler pin 64 away from the feed hub assembly 26. The first and second idler wheels 18,20 are thus spaced away from the feed hub assembly 26 and the first and second belts 22,24 are tensioned. The carcass 28 is now free to move with its first and second elongated carcass retaining slots 112,114 in engagement with the first and second carcass locating pins 58,60. Since the distance between the drive wheel 16 and the second idler wheel 20 has been increased the carcass 28 is free to take up a position where it is in contact with neither the drive wheel 16 nor the second idler wheel 20. Friction between the carcass 28 and the wheel members 16,18,20 is thus removed and the wheel members 16,18,20 are free to rotate.

In an alternative embodiment not shown in the drawings the upper plate 50 is replaced by a pair of upper plates. One of the pair of upper plates carries the carcass locating pins 58,60 and the other carries the second idler pin 64. Each of the two upper plates in the second embodiment engage the cam roller but the upper plate bearing the second idler pin 64 is caused to move a greater distance than the upper plate bearing the carcass locating pins 58,60. In this way the cartridge 40 can be stretched apart in a positive fashion rather than relying upon freedom of movement of the carcass on elongated carcass retaining slots 112,114.

The invention has so far been described with reference to a cartridge wherein the belts take an active part in the operation of the cartridge. The cartridge may equally well be of a type where the belt is not required to participate in the activity of the wheels but merely to retain the wheels. In such a cartridge it is merely necessary to provide means whereby, upon operation of the tension arm 66, the belt or belts are moved clear of the wheels on one or more wheels which themselves may or may not be required to participate in the mechanical function of the cartridge.

I claim:

1. A system including a replaceable cartridge and a base for receiving said cartridge; said cartridge including a central carcass having a plurality of recesses formed therein, a plurality of replaceable wheel members disposed respectively in said recesses; said base including a plurality of bearing members respectively for said plurality of wheel members, an elastic belt passing around the outside of said carcass and engaging said plurality of wheel members; said belt being operative to retain each of said plurality of wheel members in its respective recess when said cartridge is not mounted on said base; means for mounting said cartridge on said base whereby said bearing members engage respective ones of said wheel members, said base comprising means operative upon the mounting of said cartridge on said base for moving at least one of said bearing members away from another bearing member, said carcass being free thereafter to move relative to said base to take up a position wherein said wheel members can rotate respectively about said bearing members.

2. A system according to claim 1 wherein said carcass comprised an elongated carcass retaining slot, said base comprising a carcass locating pin, said freedom of movement of said carcass relative to said base being achieved by the movement of said carcass locating pin within said elongated carcass retaining slot.

3. A system according to claim 2 wherein at least one of said bearing members comprises a hub assembly operative to engage and hold its respective wheel member when said last mentioned wheel member is seated thereon, said hub assembly including a release button, and being operative to release and eject its respective wheel member in response to depression of said release button.

4. A system according to claim 3 wherein said wheel member for engaging said hub assembly comprises a plurality of locating splines disposed on an inner surface of a void in said last mentioned wheel member; said hub assembly comprising a plurality of drive splines operative to engage said locating splines such that a drive spline lies adjacent to a locating spline; said hub assembly comprising a locking member operative to move relative to said drive splines when said locating splines are fully engaged with said drive splines, said locking member contacting an upper surface of the locating spline of said wheel member which lies adjacent to a drive spline, thereby preventing relative movement of the locating and drive splines and locking the wheel member on said hub assembly.

5. A system according to claim 4 wherein said hub assembly comprises an ejection member; said ejection member being comprises of a cylindrical body having at one extremity thereof a plurality of radially disposed flanges and at its opposite extremity, a plurality of axially disposed locking arms, said locating splines being operative to engage said flanges of said ejection member and to depress said locking arms of said ejection member against elastic restitutional force when the wheel member is disposed on said hub assembly; the depression of said locking arms of said ejection member permitting said locking member to rotate to a locked position indicative of its contact with said upper surface of said locating spline adjacent to a drive spline, said locking member being operative to engage said locking arms of said ejection member to retain said ejection member in a fully depressed condition; said release button being operative to rotate said locking member back to an unlocked position, said elastic restitutional force causing said flanges of said ejection member to push against said locating splines to urge the wheel member from said hub assembly, and said locking arms of said ejection member moving to engage said locking member to retain said locking member in said unlocked position until said ejection member is again depressed.

6. A system according to claim 5 wherein said base includes a fixed baseplate and a movable plate slidably disposed thereon, said movable plate having mounted thereon at least one of said bearing members distinct from said bearing member which comprises said hub assembly, tension lever means affixed to said base plate, a cam recess formed in said movable plate, said tension lever means including a cam arm disposed in said cam recess, said tension lever means being operative upon the mounting of said cartridge on said base to cause said movable plate to slide in a direction which further separates the bearing member mounted on said movable plate from said hub assembly, the latter assembly being mounted on said base proximate said movable plate, said tension lever means thereby tensioning said belt and causing the wheel member associated with the last mentioned bearing member and hub assembly to be spaced away from said carcass and to be free to rotate.

7. A system according to claim 6 wherein said carcass includes an elongated slot, said tension lever means having a tang for engaging said slot when said tension lever means is operated, thereby locking said cartridge on said base.

8. A system according to claim 7 wherein said wheel member disposed on said bearing member comprised of a hub assembly is a drive wheel, and the wheel members disposed on said remaining bearing members are respective idler wheels.

9. A replaceable cartridge system comprising in combination of a cartridge assembly, said cartridge assembly including a carcass, said carcass having a central body portion, a pair of plates affixed to opposite sides of said body portion whereby said plates are held in parallel spaced-apart relation to each other, a plurality of pairs of arcuate openings formed in said plates, each of said pairs of openings being substantially identical and being homologously disposed in respective ones of said plates, a plurality of wheel members situated respectively in said plurality of pairs of arcuate openings, a pair of belts disposed in proximity to said plates and encircling respectively opposite extremities of said wheel members, said belts urging said wheel members against said plates, at least one of said plates having a plurality of spaced-apart carcass retaining slots;

a base assembly for mounting said cartridge assembly, said base assembly comprising a fixed baseplate and a movable plate slidably disposed thereon, said movable plate having a plurality of carcass locating pins protruding therefrom for disposition respectively within said carcass retaining slots, a plurality of bearing members for engaging respectively said wheel members, one of said bearing members being affixed to said base assembly proximate said movable plate and at least one additional bearing member being affixed to said movable plate, and means for moving said movable plate in relation to said fixed plate whereby said pair of belts are tensioned and said wheel members associated respectively with said bearing members on the respective fixed and movable plates are spaced apart, the interaction of said carcass locating pins with said carcass retaining slots permitting said carcass assembly to assume a position where it avoids contact with said wheel members thus permitting said wheel members to rotate freely.

10. A replaceable cartridge system as defined in claim 9 wherein said wheel member disposed on said bearing member affixed to said movable plate has a waisted central section formed by joining two frusto-conical sections at their respective narrow extremities, said last mentioned joined sections forming said wheel member.

A replaceable cartridge system as defined in claim

11. Wherein said bearing member affixed to said base assembly comprises a feed hub assembly, said feed hub assembly including a hub base with a keyed aperture set in a platform section thereof, said platform having a plurality of aperture formed therein, an ejector ring spring mounted within said hub base and having a plurality of locking arms adapted to protrude through said apertures in said platform of said hub base, a locking ring disposed adjacent said hub base and having a plurality of passages therein, a release button having a plurality of release arms, said release arms passing through said passages in said locking ring, said release button further having a plurality of securing legs which pass through said passages in said locking ring, said hub base having leg securing passages in said platform, said securing legs being retained in said leg securing passages.

12. A replaceable cartridge system as defined in claim 11 wherein said wheel member associated with said feed hub assembly is a drive wheel and includes on its inner surface a plurality of locating splines, said hub base having on its outer surface a plurality of drive splines, said locating splines and said drive splines being contiguously disposed when said last mentioned wheel member is received on said feed hub assembly.

* * * * *